US005638656A

United States Patent [19]

Roe

[11] Patent Number: 5,638,656

[45] Date of Patent: Jun. 17, 1997

[54] CONCRETE SMOOTHING APPARATUS

[76] Inventor: Cliffton L. Roe, 38020 Hazel, Harrison Township, Mich. 48045

[21] Appl. No.: 628,950

[22] Filed: Apr. 8, 1996

Related U.S. Application Data

[63] Continuation-in-part of Ser. No. 463,915, Jun. 5, 1995.

[51] Int. Cl.[6] ..... E04F 21/24

[52] U.S. Cl. ..... 52/749.1; 264/293; 264/162; 404/97; 404/118; 15/79.1

[58] Field of Search ..... 52/371, 741.41, 52/749.1, 749.13; 264/31, 293, 333, 162, 163; 425/470, 472, 445; 404/96, 97, 118; 15/201, 222, 81, 79.1

[56] References Cited

U.S. PATENT DOCUMENTS

| | | | |
|---|---|---|---|
| 867,852 | 10/1907 | Switzer et al. . | |
| 883,548 | 3/1908 | Laitner | 15/222 |
| 1,817,687 | 8/1931 | Heltzel . | |
| 2,155,571 | 4/1939 | Tullis . | |
| 2,571,876 | 10/1951 | Heltzel . | |
| 2,734,433 | 2/1956 | Brown . | |
| 4,702,640 | 10/1987 | Allen . | |
| 4,722,637 | 2/1988 | Glesmann . | |
| 4,759,658 | 7/1988 | Manor | 15/222 X |
| 4,789,265 | 12/1988 | Wilson et al. | 404/96 X |
| 4,906,126 | 3/1990 | Wilson et al. | 404/96 X |
| 5,357,644 | 10/1994 | Theriault | 15/201 X |

*Primary Examiner*—Wynn E. Wood
*Assistant Examiner*—Timothy B. Kang
*Attorney, Agent, or Firm*—Young & Basile, P.C.

[57] ABSTRACT

An apparatus and methodology for smoothing relatively small pads of freshly laid concrete. In one embodiment the smoothing apparatus comprises a pair of broom assemblies joined by a gang bar structure and each pivotally movable on the gang bar structure between first and second angularly displaced positions. With the broom assemblies in their first angular positions, the smoothing apparatus is moved in one direction across a first section of the pad by a first worker pulling on a first rope and a second worker commensurately letting out a second rope, whereafter the smoothing apparatus may be moved laterally on the pad to overlie a second section of the pad laterally adjacent the first pad section and the smoothing apparatus may be moved in the opposite direction across the second section of the pad with the broom assemblies in their second angular positions, the second worker pulling on the second rope, and the first worker commensurately letting out the first rope. In a second embodiment, the smoothing apparatus comprises a forward fresno assembly and a rearward broom assembly, the apparatus is moved back and forth across the pad utilizing a single rope swivelly secured to the apparatus, and the apparatus is swiveled 180° as it is moved laterally on the pad between successive lateral sections so that the fresno is always in the lead.

17 Claims, 5 Drawing Sheets

CONCRETE SMOOTHING APPARATUS

RELATED APPLICATION

This application is a continuation-in-part of U.S. patent application Ser. No. 08/463,915 filed on Jun. 5, 1995.

BACKGROUND OF THE INVENTION

This invention relates to concrete smoothing apparatuses and more particularly to a manual concrete smoothing apparatus for use in smoothing relatively small areas of fresh concrete.

Fresh concrete, when laid in large areas, is typically smoothed utilizing power machinery. However, when the area of the freshly laid cement is relatively small, hand smoothing techniques, employing brooms or burlap and the like, are typically utilized to accomplish the smoothing function. These hand smoothing techniques are very time consuming and often do not produce a totally satisfactory surface.

SUMMARY OF THE INVENTION

The invention is directed to the provision of an improved finishing apparatus and methodology for manually smoothing small surface areas such as areas of freshly laid concrete.

The invention finishing apparatus includes a longitudinally extending frame structure; pivot means at the forward and rearward ends of the frame structure defining forward and rearward transverse pivot axes; a mounting plate mounted for pivotal movement on each pivot axis; a forward transversely extending finishing tool attached to the forward mounting plate; a rearward transversely extending finishing tool attached to the rearward mounting plate; a gang bar extending between the forward and rearward mounting plates so that the mounting plates and finishing tools move in unison about the respective pivot axes; coacting locking means on the frame structure and gang bar for locking the mounting plates and the finishing tools in selected positions of angular adjustment; and at least one flexible line attached to the apparatus for pulling the apparatus in a longitudinal direction over the surface area. This apparatus shortens the time required to perform the finishing operations on the surface and improves the overall quality of the finishing operations.

According to a further feature of the invention apparatus, the coacting means includes a pin on the frame structure and a link pivotally mounted at one end to the gang bar and including a slot at its other end slidably receiving the pin. This specific arrangement provides a ready and efficient means of locking the mounting plates and finishing tools in any desired position of angular adjustment.

According to a further feature of the invention apparatus, the pin comprises the threaded shaft of a bolt and the coacting means further includes a nut carried on the frame structure and threadably receiving the threaded bolt shaft. This specific locking means structure allows the finishing tools to be readily and efficiently locked in any desired angular position.

In one embodiment of the finishing apparatus, the forward and rearward finishing tools are brooms and in a further embodiment of the finishing apparatus the forward tool is a fresno and the rearward tool is a broom.

The invention methodology comprises the steps of providing a finishing apparatus including a longitudinally extending frame structure, a forward finishing tool positioned transversely of the frame structure at a forward end of the frame structure and a rearward finishing tool positioned transversely of the frame structure at a rearward end of the frame structure; providing a flexible line and positioning the line longitudinally in overlying relation to the apparatus; securing the flexible line to the frame structure at a location between the ends of the flexible line with a connection that allows swiveling movement of the finishing apparatus relative to the line; positioning a first worker at one side of the surface area; positioning a second worker at an opposite side of the surface area; positioning the finishing apparatus on a first section of the surface area; moving the finishing apparatus in a first longitudinal direction across the first section of the surface area with the first worker pulling on the flexible line and the second worker commensurately letting out the flexible line whereby to allow the forward and rearward flexible tools to perform successive first and second finishing operations on the first section of the surface area; thereafter moving the finishing apparatus laterally on the surface area to a second section of the surface area laterally adjacent the first section of the surface area and swiveling the finishing apparatus through approximately 180° relative to the flexible line; and thereafter moving the finishing apparatus in a second opposite longitudinal direction across the second section of the surface area with the second worker pulling on the flexible line and the first worker commensurately letting out the flexible line whereby to allow the forward and rearward flexible tools to perform successive first and second finishing operations on the second section of the surface area. This methodology allows successive finishing operations to be performed on successive sections of a surface area such as a concrete pad by workers positioned on opposite sides of the pad manipulating a flexible line secured to a finishing apparatus.

According to a further feature of the invention methodology, the flexible line is secured to a forward end of the finishing apparatus so that the finishing apparatus may track the movement of the flexible line as the finishing apparatus moves back and forth across the surface area under control of the workers positioned at the opposite sides of the surface area.

DETAILED DESCRIPTION OF THE PREFERRED EMBODIMENT

Figures 1, 9:
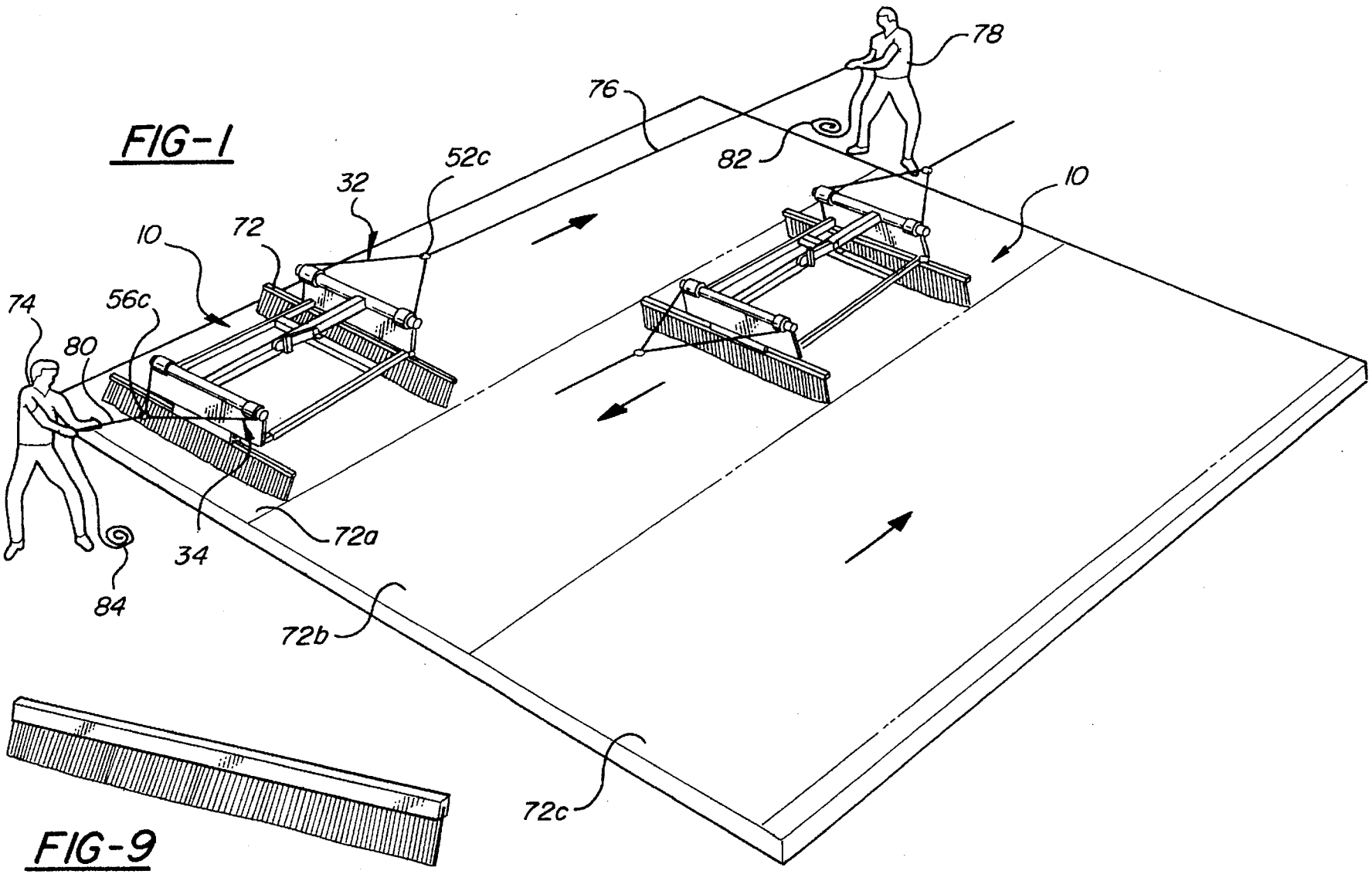
FIG. 1 is a perspective somewhat schematic view illustrating the invention smoothing apparatus and the invention methodology.
FIG. 9 is a perspective view of an alternate finishing tool for use with the invention smoothing apparatus.

The invention smoothing apparatus 10, broadly considered, includes a frame bar 11, a front pivot rod 12, a rear pivot rod 14, a front mounting plate structure 16, a rear mounting plate structure 18, a front bracket 20, a rear bracket 22, left and right gang bars 24 and 26, a forward finishing tool 28, a rearward finishing tool 30, a forward harness 32, a rearward harness 34, and a locking mechanism 35.

Frame bar 11 may have, for example, a rectangular, tubular cross-sectional configuration and extends longitudinally. Pivot rod 12 is fixedly secured as by welding to the forward end 11*a* of the frame bar and extends transversely of the forward end of the frame bar. Rearward pivot rod 14 is secured as by welding to the rear end 11*b* of the frame bar and extends transversely of the rearward end of the frame bar. Pivot rods 12 and 14 may, for example, have a circular tubular configuration.

Forward mounting plate structure 16 includes a mounting plate 36 and left and right journals 38. Journals 38 are journaled on opposite ends of pivot rod 12 and mounting plate 36 is fixedly secured as by welding to the lower peripheries of journals 38 so as to turn with journals 38 about the pivot axis defined by pivot rod 12. Similarly, rearward mounting plate structure 18 includes journals 40 journaled on opposite ends of pivot rod 14 and a journal plate 18 fixedly secured as by welding to the lower perimeters of journals 40 so that the rearward mounting plate structure may pivot about the transverse axis defined by pivot rod 14.

Forward bracket 20 has a plate-like configuration and is secured as by fasteners 44 to pivot mounting plate 36. Similarly, rearward bracket 22 has a plate-like configuration and is secured as by fasteners 46 to rearward mounting plate 42.

Figure 2:
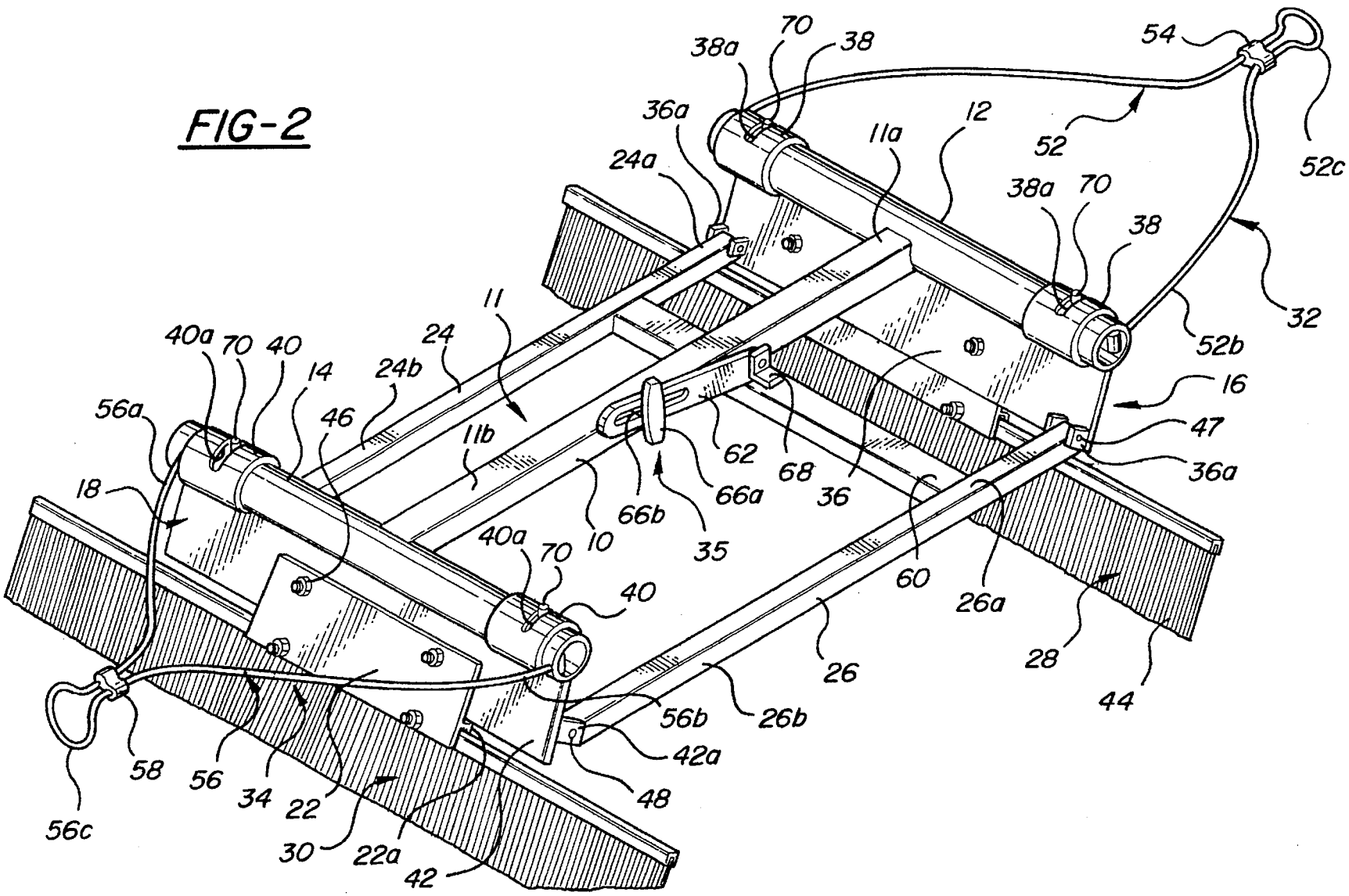
FIG. 2 is a perspective view of the invention smoothing apparatus.
Figure 3:
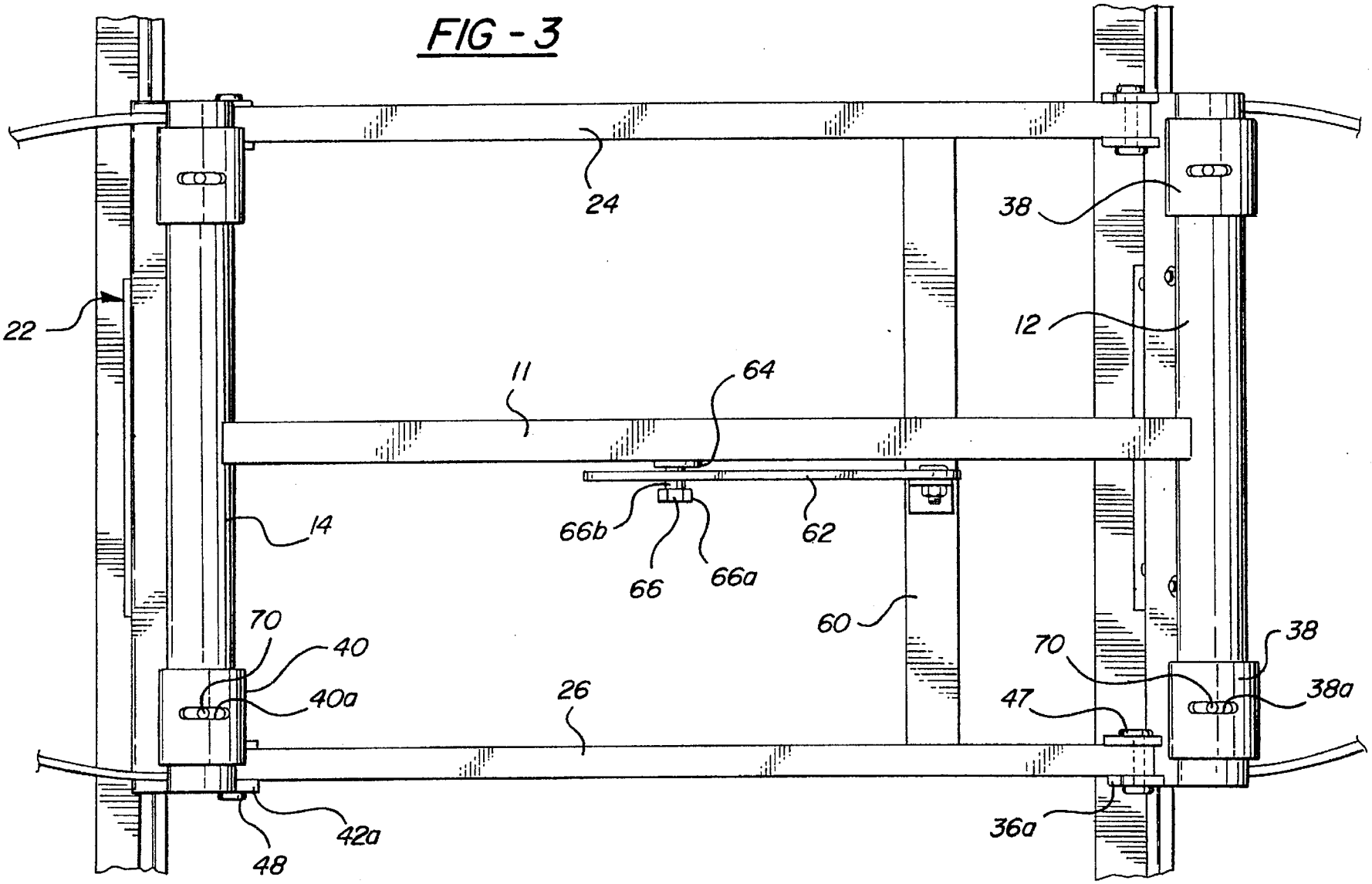
FIG. 3 is a plan view of the invention smoothing apparatus.

Left and right gang bars 24 and 26 extend longitudinally and may have a rectangular, tubular, cross-sectional configuration. The front ends 24*a*, 26*a* of gang bars 24, 26 are pivotally mounted by lugs 36*a* and pins 47 on the lower edge of forward mounting plate 36 and the rearward ends 24*b*, 26*b* of the gang bars are pivotally mounted by lugs 42*a* and pins 48 on the lower edge of rearward mounting plate 42. Forward finishing tool 28 may comprise a concrete broom 44, as seen in FIGS. 1, 2, and 3, or may comprise a fresno 46, as seen in FIGS. 4, 5, 6 and 7. Forward finishing tool 28 is secured along its upper transverse edge to forward mounting plate 36 utilizing bracket 20 with a lower clevis portion 20*a* of the bracket embracing the upper edge of the finishing tool and suitably secured thereto as by fasteners 50.

Rearward finishing tool 30 comprises a concrete broom and is secured along its upper edge 30*a* to mounting bracket 42 via a lower clevis portion 22*a* of bracket 22.

Forward harness 32 comprises a cable 52 secured at its opposite ends 52*a* and 52*b* to the left and right ends of pivot rod 12 and includes a forward loop 52*c* defined by a clench member 54.

Rearward harness 34 comprises a cable 56 including left and right ends 56*a* and 56*b* secured to the left and right ends of pivot rod 14 and includes a rearward loop 56*c* defined by a clench member 58.

Lock mechanism 35 includes a cross bar 60, a link 62, a nut 64, and a bolt 66. Cross bar 60 extends between gang bars 24 and 26 at a relatively forward location and the forward end 62*a* of link 62 is pivotally mounted on cross bar 60 via an angle bracket 68. The rearward end of link 62 includes a slot 62*b*. Nut 64 is fixedly secured to the side face of frame bar 11 at the longitudinal midpoint of the bar. Bolt 66 includes an oblong bolt head portion 66*a* and a threaded shaft portion 66*b* passing through slot 62*b* for threaded engagement with nut 64. Forward threading movement of bolt shaft portion 66*b* into nut 64 has the effect of clamping link 62 between the bolt head 66*a* and nut 64 so as to lock the front and rear finishing tools in any desired position of angular adjustment. The limit of forward and rearward pivotal movement of the front and rear finishing tools is determined by slots 38*a* and 40*a* in journals 38 and 40 coacting with pins 70 upstanding from pivot shafts 12 and 14 and received in the respective slots.

To smooth the freshly laid concrete pad 72 utilizing the invention apparatus and methodology, smoothing apparatus 10 is positioned (FIG. 1) in one corner of pad 72 in overlying relation to a section 72*a* of the pad and the smoothing apparatus is moved along section 72*a* across the entire width of the pad by a first worker 78 positioned on one side of the pad and pulling on a rope or other flexible line 76 secured to loop 52*c* of forward harness 32 and a second worker 74 positioned on the opposite side of the pad and playing out a rope or other flexible line 80 secured to loop 56*c* of rearward harness 34. The brooms 30 and 44 may be allowed to pivot to their rearwardly angled position, as seen in FIGS. 1 and 2, as determined by coaction by pins 70 and slots 38*a* and 40*a* or the brooms may, prior to movement across the pad, be moved to their rearwardly angled position and locked in that position by suitable rotation of bolt 66 to clamp the link 62 between the bolt head and frame bar 11 and lock the brooms in their rearwardly angled position. In either event, the brooms perform a smooth sweeping and leveling action on the surface of the pad.

As smoothing apparatus 10 is moved across the pad, rope 76 is reeled in by worker 78 and arranged in a rope coil 82 while rope 80 is commensurately played out by worker 74 to deplete a rope coil 84. After the smoothing apparatus has moved across the pad and reached the far side of the pad to complete the smoothing of section 72*a*, workers 74 and 78 work together to lift the smoothing apparatus to the next laterally adjacent section 72*b*.

Brooms 30 and 44 may now be moved utilizing the lock mechanism 35 to a locked forwardly angled position or the brooms may be allowed to assume this position naturally as the smoothing apparatus is moved back across the pad. The described procedure is now reversed with worker 74 pulling on rope 80 and worker 78 playing out rope 76. The smoothing apparatus thus once again moves across the pad, in an opposite direction, to smooth the section 72*b*. This procedure is repeated on successive pad sections 72*c*, etc. with the direction of movement of the smoothing apparatus across the pad and the angular position of the brooms being reversed for each successive pad section until the entire pad has been smoothed.

Figures 4, 8:
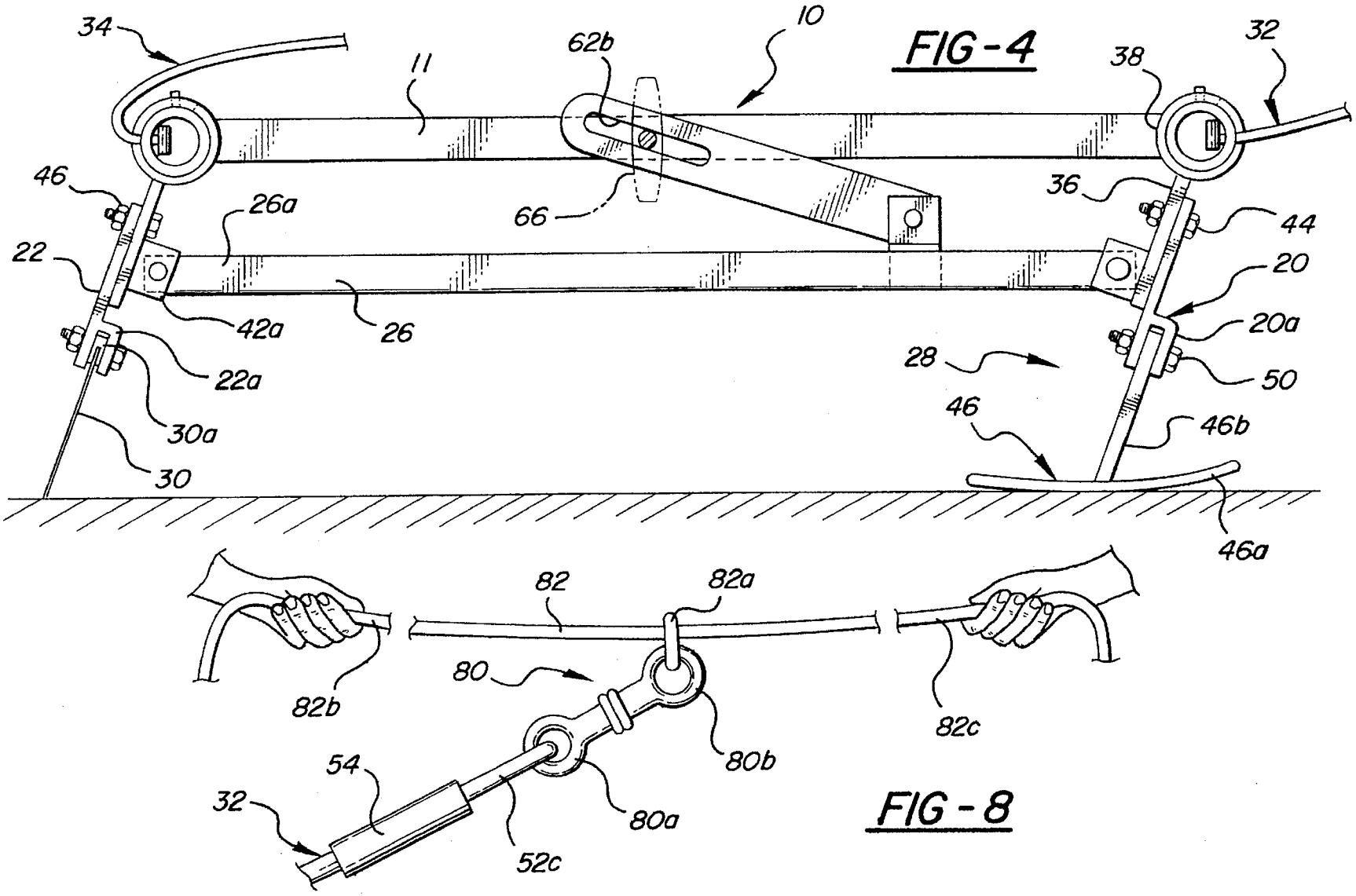
FIG. 4 is a side elevational view of the invention smoothing apparatus equipped to carry out a modified methodology.
FIG. 8 is a detail view illustrating the modified methodology.

FIGS. 4–8 illustrate the invention apparatus and methodology wherein the forward and rearward finishing tools 28 and 30 are dissimilar as, for example, when the rearward finishing tool continues to be a brush but the forward finishing tool is a fresno 46 secured to the front mounting plate 36. Fresno 46 includes a base portion 46*a* of arcuate cross-sectional configuration and a mounting rib portions 46*b*. In this scenario the lock mechanism 35 is adjusted so as to lock the brush 30 and fresno 46 in a rearwardly angled position as seen in FIG. 4 and a swivel joint 80 is positioned at the forward end of forward harness 32 with a lower loop 80*a* of the swivel joint engaging in loop 52*c* and an upper loop 80*b* of the swivel joint secured to a flexible line or rope 82 via a loop or knot 82*a* in the rope.

In carrying out the methodology of FIGS. 4–8, workers 74 and 78 grasp the single rope 82 proximate opposite ends 82*b* and 82*c* of the rope and pull the smoothing apparatus across the pad section 72*a* from worker 74 toward worker 78 with fresno 46 initially smoothing the concrete surface and brush 30 performing a further, subsequent smoothing operation on the concrete. The movement of the smoothing apparatus across section 72*a* is accomplished by worker 78 pulling on end 82*c* of rope 82 and allowing the rope to arrange in a rope coil 82*d* while worker 74 plays out the rope to deplete a rope coil 82*e*. Since the flexible line 82 is secured to the forward or leading end of the smoothing apparatus via forward harness 32 and swivel 80, the finishing apparatus tracks the movement of the flexible line. Trailing harness 34 may either be draped over frame 11 or removed from the smoothing apparatus.

Figure 5:
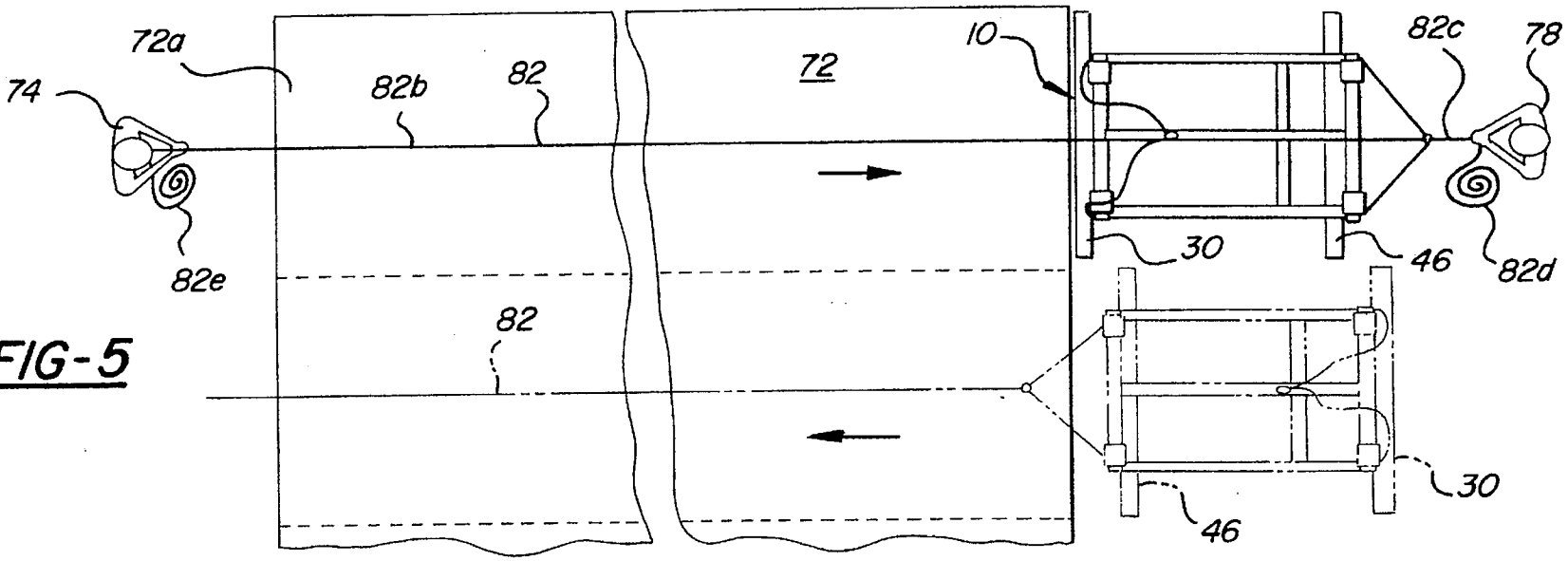
FIGS. 5, 6, and 7 are schematic views illustrating the modified methodology.
Figure 6:
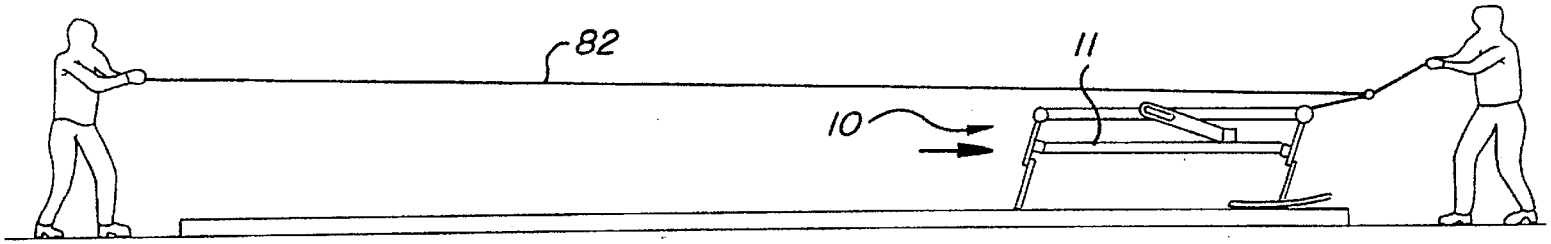
Figure 7:
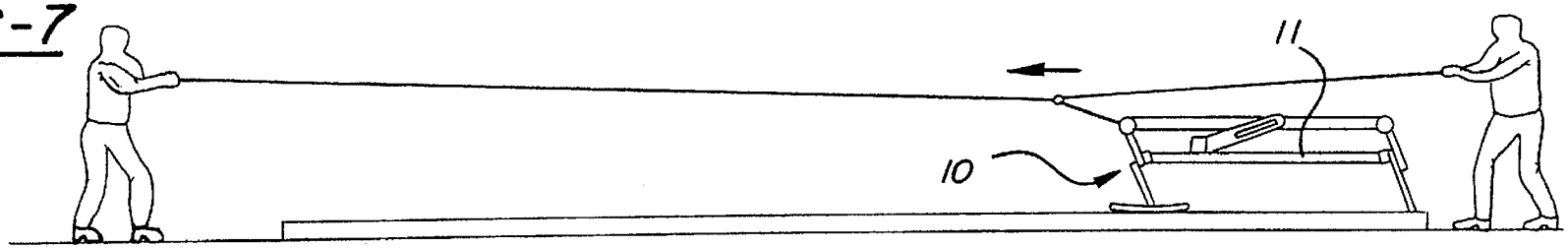

Once the smoothing apparatus has cleared the far side of the pad, as seen in solid lines in FIG. 5, workers 74 and 78 laterally side step to move the smoothing apparatus laterally to a position in alignment with pad section 72*b* and worker 78 spins the smoothing apparatus, utilizing swivel joint 80, through 180° so as to position the smoothing apparatus in the position seen in dashed lines in FIG. 5 in alignment with pad section 72*b* with fresno 46 again leading brush 30.

The smoothing apparatus may now be moved across pad section 72 *b* in an opposite direction with worker 78 playing out rope from the coil 82*d* and the worker 74 reeling in rope for arrangement in coil 82*e*. After the smoothing apparatus has moved across the pad and cleared the far side of the pad to complete the smoothing of section 72 *b*, the procedure may be repeated with the workers moving laterally to position the smoothing apparatus in alignment with pad section 72*c* and worker 74 spinning the apparatus through 180° utilizing swivel joint 80 to position the smoothing apparatus for movement across pad section 72*c* with fresno again leading brush 30. This procedure is repeated on successive pad sections with the direction of movement of the smoothing apparatus across the pad being reversed for each successive pad section until the entire pad has been smoothed.

The invention will be seen to provide an apparatus and methodology for quickly and effectively smoothing freshly laid concrete or other surfaces utilizing a simple and inexpensive apparatus and requiring relatively unskilled labor.

Whereas the invention has been illustrated and described in detail with respect to preferred embodiments, it will be apparent that various changes may be made in the disclosed embodiment without departing from the scope or spirit of the invention. For example, although the invention has been described with reference to finishing tools in the form of either a concrete brush or a fresno, the invention smoothing apparatus may be used with other finishing tools such, for example, as the wire brush seen in FIG. 9 which may be used as a rearward finishing tool with a fresno serving as the forward finishing tool.

I claim:

1. A finishing apparatus for performing finishing operations on a surface area comprising:

a longitudinally extending frame structure;

pivot means at the forward and rearward ends of the frame structure defining forward and rearward transverse pivot axes;

forward and rearward mounting plates mounted on the forward and rearward pivotal axes;

a forward transversely extending finishing tool attached to the forward mounting plate and having a free edge surface for interfacing and finishing the surface area;

a rearward transversely extending finishing tool attached to the rearward mounting plate and having a free edge surface for interfacing and finishing the surface area;

a gang bar extending between the forward and rearward mounting plates so that the mounting plates and finishing tools move in unison about the respective pivot axes;

coacting locking means on the frame structure and gang bar for locking the mounting plates and finishing tools in selected positions of angular adjustment; and at least one flexible line attached to the apparatus for pulling the apparatus in a longitudinal direction over the surface area;

the finishing apparatus contacting the surface area as the apparatus is pulled over the surface area only at the finishing interfaces of the forward and rearward tools and the surface area so that the forward and rearward tools support the entire weight of the finishing apparatus as the finishing apparatus moves over the surface area.

2. A finishing apparatus according to claim 1 wherein the coacting locking means includes a pin on the frame structure and a link pivotally mounted at one end to the gang bar and including a slot at its other end slidably receiving the pin.

3. A finishing apparatus according to claim 2 wherein the pin comprises the threaded shaft of a bolt and the coacting means further includes a nut carried on the frame structure and threadably receiving the threaded bolt shaft.

4. A finishing apparatus according to claim 1 wherein the forward and rearward finishing tools are brooms.

5. A finishing apparatus according to claim 1 wherein the forward tool is a fresno and the rearward tool is a broom.

6. A smoothing apparatus for performing a smoothing operation on a fresh concrete pad comprising:

a longitudinally extending frame structure;

pivot means at the forward and rearward ends of the frame structure defining forward and rearward pivot axes;

forward and rearward mounting plates mounted for pivotal movement on the forward and rearward pivot axes;

a forward transversely extending finishing tool attached to the forward mounting plate and having a free edge surface for interfacing and finishing the surface area of the concrete pad;

a rearward transversely extending finishing tool attached to the rearward mounting plate and having a free edge surface for interfacing and finishing the surface area of the concrete pad;

a gang bar extending between the forward and rearward mounting plates so that the mounting plates and finishing tools may move in unison about the respective pivot axes;

coacting locking means on the frame structure and gang bar for locking the mounting plates and the finishing tools in selected positions of angular adjustment; and at least one flexible line attached to the apparatus for pulling the apparatus in a longitudinal direction across the concrete pad;

the finishing apparatus contacting the surface area of the concrete pad as the apparatus is pulled across the concrete pad only at the finishing interfaces of the forward and rearward tools and the surface area so that the forward and rearward tools support the entire weight of the finishing apparatus as the finishing apparatus moves across the concrete pad.

7. A finishing apparatus according to claim 6 wherein the forward and rearward finishing tools are brooms.

8. A finishing apparatus according to claim 6 wherein the forward tool is a fresno and the rearward tool is a broom.

9. A method of performing finishing operations on a surface area comprising the steps of:

providing a finishing apparatus including a longitudinally extending frame structure, a forward finishing tool positioned transversely of the frame structure at a forward end of the frame structure, and a rearward finishing tool positioned transversely of the frame structure at a rearward end of the frame structure;

providing a flexible line and positioning the line longitudinally in overlying relation to the apparatus;

securing the flexible line to the frame structure of the apparatus at a location between the ends of the flexible line with a connection that allows swiveling movement of the finishing apparatus relative to the line;

positioning a first worker at one side of the surface area;

positioning a second worker at an opposite side of the surface area;

positioning the finishing apparatus on a first section of the surface area;

moving the finishing apparatus in a first longitudinal direction across the first section of the surface area with the first worker pulling on the flexible line and the second worker commensurately letting out the flexible line whereby to allow the forward and rearward flexible tools to perform successive first and second finishing operations on the first section of the surface area;

thereafter moving the finishing apparatus laterally on the surface area to a second section of the surface area laterally adjacent the first section of the surface area and swiveling the finishing apparatus through approximately 180 degrees relative to the flexible line; and thereafter moving the finishing apparatus in a second opposite longitudinal direction across the second section of the surface area with the second worker pulling on the flexible line and the first worker commensurately letting out the flexible line whereby to allow the forward and rearward flexible tools to perform successive first and second finishing operations on the second section of the surface area.

10. A method according to claim 9 wherein the forward finishing tool comprises a fresno and the rearward finishing tool comprises a broom.

11. A method according to claim 9 wherein the forward finishing tool comprises a fresno and the rearward finishing tool comprises a wire brush.

12. A method according to claim 9 wherein the rearward finishing tool is mounted for pivotal movement relative to the frame structure about a transverse axis.

13. A method according to claim 12 wherein the forward finishing tool is also mounted for pivotal movement relative to the frame structure about a transverse axis.

14. A method according to claim 9 wherein the flexible line is secured to a forward end of the finishing apparatus so that the finishing apparatus may track the movement of the flexible line.

15. A method of manually smoothing a pad of fresh concrete comprising the steps of:

providing a finishing apparatus including a longitudinally extending frame structure, a forward finishing tool positioned transversely of the frame structure at a forward end of the frame structure and a rearward finishing tool positioned transversely of the frame structure at a rearward end of the frame structure;

providing a flexible line and positioning the line longitudinally in overlying relation to the apparatus;

securing the flexible line to the frame structure of the apparatus at a location between the ends of the flexible line with a connection that allows swiveling movement of the finishing apparatus relative to the line;

positioning a first worker at one side of the concrete pad;

positioning a second worker at an opposite side of the concrete pad;

positioning the finishing apparatus on a first section of the concrete pad;

moving the finishing apparatus in a first longitudinal direction across the first section of the concrete pad with the first worker pulling on the flexible line and the second worker commensurately letting out the flexible line whereby to allow the forward and rearward finishing tools to perform successive first and second finishing operations on the first section of the concrete pad;

thereafter moving the finishing apparatus laterally on the concrete pad to a second section of the concrete pad laterally adjacent the first section of the concrete pad and swiveling the finishing apparatus through approximately 180° relative to the flexible line; and thereafter moving the finishing apparatus in a second opposite longitudinal direction across the second section of the concrete pad with the second worker pulling on the flexible line and the first worker commensurately letting out the flexible line whereby to allow the forward and rearward finishing tools to perform successive first and second finishing operations on the second section of the concrete pad.

16. A method according to claim 15 wherein the forward finishing tool comprises a fresno and the rearward finishing tool comprises a broom.

17. A method according to claim 15 wherein the forward finishing tool comprises a fresno and the rearward finishing tool comprises a wire brush.

* * * * *